United States Patent [19]

Lehmann

[11] Patent Number: 4,583,479

[45] Date of Patent: Apr. 22, 1986

[54] LINKED VEHICLE

[75] Inventor: Rainer Lehmann, Singhofen, Fed. Rep. of Germany

[73] Assignee: APEC Freizeitanlagen GmbH, Frankfurt, Fed. Rep. of Germany

[21] Appl. No.: 552,452

[22] Filed: Nov. 16, 1983

[30] Foreign Application Priority Data

Nov. 16, 1982 [DE] Fed. Rep. of Germany ..... 3242401
Oct. 7, 1983 [DE] Fed. Rep. of Germany ..... 3336563

[51] Int. Cl.[4] ..... B63B 7/08

[52] U.S. Cl. ..... 114/345; 114/352; 280/16

[58] Field of Search ..... 104/53, 69, 70, 72; 441/40, 43, 130–132, 65, 66; 114/77 R, 352, 353, 345; 280/16, 17, 24, 28, 400, 411 R, 504; 198/648; 298/8 T

[56] References Cited

U.S. PATENT DOCUMENTS

| | | | |
|---|---|---|---|
| 1,555,589 | 9/1925 | Farina | 441/132 |
| 1,869,186 | 7/1932 | Davidson | 441/131 |
| 2,219,585 | 10/1940 | Begin | 298/8 T |
| 2,334,072 | 11/1943 | Cooper | 114/345 |
| 3,120,963 | 2/1964 | Seckel | 280/28 |
| 3,372,944 | 3/1968 | Lauritzen | 280/17 |
| 3,408,086 | 10/1968 | Bennett | 280/28 X |
| 3,958,289 | 5/1976 | Carlson | 114/347 X |
| 4,160,299 | 7/1979 | Hilbern | 441/131 |

FOREIGN PATENT DOCUMENTS

| | | | |
|---|---|---|---|
| 853559 | 3/1940 | France | 114/352 |
| 272791 | 6/1927 | United Kingdom | 114/345 |
| 1096359 | 12/1967 | United Kingdom . | |

*Primary Examiner*—Sherman D. Basinger
*Attorney, Agent, or Firm*—Flynn, Thiel, Boutell & Tanis

[57] ABSTRACT

A linked vehicle includes several units which are arranged one after another in the longitudinal direction of the vehicle and are connected by bending links with one another so that the individual units can pivot relative to one another. The individual units can include two frame parts which can be built of one or more floating members and can be connected with one another by cross-connecting members. Rigidly constructed baskets can be inserted into open regions provided in the individual units. According to a further development of the invention, the units have sliding surfaces provided on their underside and possibly also on their side walls, which sliding surfaces can support the links on a fixed base and are made of a slidable material which has, on the material of the fixed base, a friction coefficient which is as low as possible. The base can be formed by a channel in which the vehicle is driven and guided by potential energy. The linked vehicles can be utilized in amusement parks, where they can be guided in water-carrying channels or in dry channels.

2 Claims, 17 Drawing Figures

LINKED VEHICLE

FIELD OF THE INVENTION

This invention relates to a linked vehicle having plural units which are linked together.

BACKGROUND OF THE INVENTION

In conventional linked vehicles such as boats, the body of the boat is constructed as a substantially rigid member which follows the movements caused by the flow of the water as a whole, without deforming to any degree worth mentioning. In cases in which the carrying water has a very uneven surface, has a significant vertical drop, and/or has in directions perpendicular to the direction of travel a very limited width, a boat with a rigid body proves to be very bulky and not very maneuverable, and the body of the boat is exposed to strong mechanical stresses since, for example, there are times when large parts of the boat project out of the water. An example in which such relationships exist are wild-water rapids or streams and corresponding artificially made wild-water channels in amusement parks.

In the wild-water channels in amusement parks, uncontrolled boats are used which, without any independent drive, come down the wild-water channel. The boats which are used for this are typically round boats, namely boats which are built in the form of a circle, wherein the floating member consists primarily of a circular inflated hose. The bottom of this boat is flat. Such round boats have a very poor lateral center of gravity. The boat is easily inclined, whereby the lower-lying side is then easily moved under the water. Furthermore, these boats are easily urged out of the center of the wild-water channel, where the largest flow velocity exists, and are urged toward the bank, where the flow velocity is lower. Similar problems exist in so-called speed boats which, within an artificially made water channel, travel rapidly downwardly from a relatively great height. These speed boats have, as a rule, a more slender shape and are longer than the aforementioned circular boats for the wild-water channels. They are very sensitive to unevenness of the guiding channel.

During operation of boats of the aforementioned type in artificial water channels, one must always take care that the water channels carry a sufficient amount of water so that the boat can float. This is particularly difficult in the case of water channels with stretches of rapid downhill travel, since here the drop of the water channel is very great. Engagement of the boat with the bottom of the water-conducting channel often cannot be avoided, which results in damage to the channel and boat and reduces the speed of the boat in an undesired manner.

A basic purpose of the invention is to provide a nonfloatable vehicle or a vehicle which floats stably on very uneven water or in a very uneven fixed channel and which in either case follows very well the water flow in relatively narrow wild-water channels or the guiding of a water-conducting or a dry channel.

To attain this purpose, a linked vehicle is provided which includes several longitudinally spaced, substantially rigid, floating or nonfloating units which are connected with each other in such a manner that the units can be pivoted with respect to one another and/or can be moved relative to one another in directions perpendicular to the longitudinal direction of the vehicle.

BRIEF DESCRIPTION OF THE DRAWINGS

The invention is discussed in greater detail hereinafter in connection with the exemplary embodiments which are shown in the figures.

In the drawings.

DETAILED DESCRIPTION

Figure 1A:
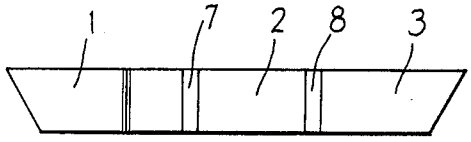
FIGS. 1*a* and 1*b* are respectively a side view and a top view of a floatable linked boat embodying the invention.
Figure 1B:
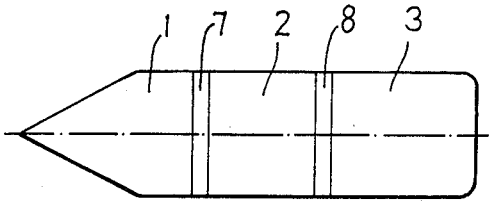

FIGS. 1*a* and 1*b* illustrate the principle of the invention. The figures illustrate an upwardly open (cover-free) boat, namely in a side view in FIG. 1*a* and in a top view in FIG. 1*b*. The boat includes three units which are arranged one behind the other in a longitudinal direction, namely, a front unit 1, a center unit 2 and a rear unit 3. The adjacent pairs of units 1, 2 and 2, 3 are connected water-tight with one another by connecting strips 7 and 8. The connecting strips 7 and 8 extend perpendicular with respect to the longitudinal direction of the boat across the bottom and up the sides of the boat. These connecting strips are made of elastic and/or a very flexible material. Due to these soft connecting strips, the units can move with respect to one another, namely about horizontal axes which extend perpendicular with respect to the longitudinal direction of the boat and also about vertical axes which extend perpendicular with respect to the longitudinal direction of the boat. These axes each extend through the connecting strips. In the case of very flexible connecting strips 7 and 8, the units can also be moved relative to one another in respective directions which are parallel and are perpendicular with respect to the longitudinal direction of the boat. If the boat is provided with a closed deck, then the connecting strip must continue beyond the deck. The number of the units provided can be as desired. The water-tight connection between the connecting strips and the units can be created in many ways, for example by gluing, welding or by screwable pressure bars with the interpositioning of sealing strips.

Figure 2A:
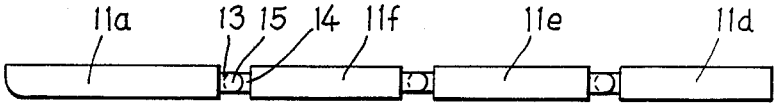
FIGS. 2*a* and 2*b* are respectively a side view and a top view of a different exemplary embodiment of the linked boat according to the invention.
Figure 2B:
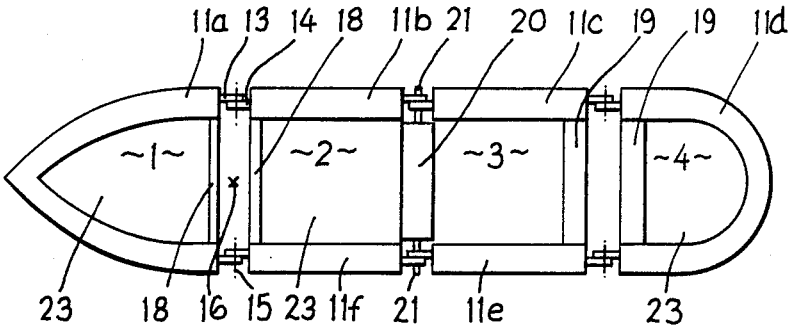

FIGS. 2*a* and 2*b* are views similar to FIGS. 1 and 1*b* and illustrate the basic design of a linked boat according to the invention in which the boat includes a frame 11 which is open in a vertical direction. The parts 11*a* to 11*f* of the frame 11 which belong to the individual units 1 to 4 are constructed as floating members, the cross section of which can have any desired shape, for example circular or rectangular. In FIG. 2*b*, the front unit 1 and the rear unit 4 each have a single frame part 11*a* or 11*d* which is generally U-shaped or in other words is bent 180°. Instead of this single frame part, of course, it is also possible for these units 1 and 4 to be built of plural rigidly connected frame parts. Also, not all frame parts must be constructed as floating members.

The frame parts of adjacent units are connected by bend links. Such a bend link can, for example, include two flanges 13 and 14 which are connected rigidly with the frame parts, through which flanges extends a short pivot pin 15. These bend links permit relative rotation of the two adjacent units about a horizontal axis, which is coaxial with the axes of two laterally opposite and aligned pivot pins 15. If one also wants to make possible a bending in a horizontal plane, or in other words about a vertical axis 16, then the swivel joints 13, 14, 15 can be ball-and-socket joints.

The parts of the frame 11 which belong to one unit can be connected with one another by cross-connecting members 18, 19, 20 which extend perpendicular with respect to the longitudinal direction of the boat. These cross-connecting members can consist of a simple rod, like the cross-connecting members which are identified with reference numeral 18 (FIG. 2*b*), or they can be constructed as floating members, such as the cross-connecting members which are identified with reference numeral 19. The cross-connecting members determine the width of the boat. The cross-connecting members lie as much as possible at the ends of the respective units in the longitudinal direction of the units, so that the individual units each form a partial frame with an open region 23 in the center which is as large as possible. Instead of providing each unit with a cross-connecting member at a connecting point between two units, as is shown in the exemplary embodiment between the units 1 and 2 and the units 3 and 4, it is possible to use a common cross-connecting member, namely in the form of a through-going axle which extends from one bend link to the opposite one. Thus, one can imagine the two pivot pins 15 in FIG. 2*b* being replaced by a single axle which extends the entire width of the boat and exactly determines the width of the boat in the case where the frame parts are not completely rigid. Also, a cross-connecting member which is common to two units can be constructed as a floating member, as is illustrated by the cross-connecting member 20 in FIG. 2. Pivot pins 21 for the bend links are thereby secured on the cross-connecting member 20.

The partial frames defining the individual units in FIGS. 2*a* and 2*b* are thus substantially rigid and can be moved in relation to one another. Baskets which are preferably rigidly constructed and downwardly closed are insertable into the open central regions 23 of each unit, which baskets absorb the effective weight of the boat. These may be baskets to accommodate people, and they are then preferably provided with seating banks, as will be discussed in greater detail in association with the exemplary embodiment according to FIGS. 3–5. The depth of the baskets can be such that they extend into the water and contribute to the total lift of the boat. The baskets are thereby supported on parts of the frame 11 and/or the cross-connecting members. In a case where no cross-connecting members are provided between the frame parts 11*a* to 11*f*, the inserted baskets can be secured to the frame parts, such that the baskets exactly determine the width of the boat.

In place of the swivel joints which are illustrated in FIGS. 2*a* and 2*b*, the bend links can also be constructed as elastically deformable intermediate pieces provided between the relatively rigid frame parts 11. One can thereby use, for example, foam materials which are provided with closed pores and are stored in flexible, water-tight covers. Finally, the bend links can also consist of inflatable chambers, whereby the pressure of the gas which is enclosed in the chambers, usually air, is selected so that the chambers can be deformed substantially softer and easier than the substantially rigid frame parts. These chambers then form so-called air hinges.

Figure 3:
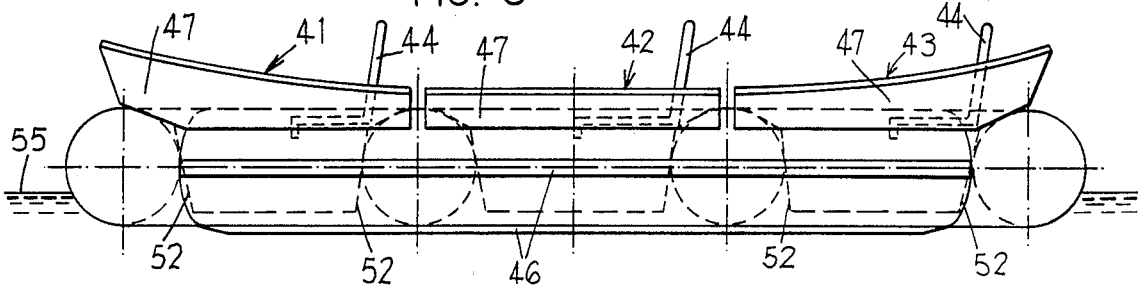
FIG. 3 is a side view of a further embodiment of a linked boat according to the invention.

An exemplary embodiment of the last-mentioned arrangement is described in greater detail in connection with FIGS. 3 to 5. The boat member which is illustrated in the top view in FIG. 4 has three units 1, 2, 3. The frame 31 includes parts 31*a* to 31*d* which are constructed as inflatable hoses, wherein the two end frame parts 31*a* and 31*c*, which are U-shaped and curved 180°, are divided advantageously into individual compartments by bulkhead partitions 32. The bend links 33*a* to 33*d* are also constructed as inflatable chambers, and the same is true for the cross-connecting members 34 and 35. The inflatable chambers which form the bend links are provided with adapter pieces 36*a* to 36*d* for the cross-connecting means. The entire space which is defined between the bulkhead partitions 32*a*, 32*b*, 32*c* represents a single chamber. The entire system of frame parts, cross-connecting members and bend link chambers is vulcanized together. Baskets 41–43 can be inserted into the partial frame opening which is formed by each link, which baskets are illustrated in FIG. 3 and can be recognized particularly well in the cross section according to FIG. 5. The baskets, on four sides thereof, engage the frame hoses and cross-connecting hoses and can be secured thereto by means of not illustrated ropes and fittings. The bottom 53 of each basket is slightly higher, in its inserted condition, than the lower surface 54 of the hoses in order to prevent ground contact by the baskets. On the other hand, however, they also extend into the water 55 and with this contribute to the buoyancy of the boat. Slightly above the bottom of each basket there is supported a grating 45, under which splash and rain water can accumulate. Seating banks 44 are installed in or can be removably inserted into the baskets. Protective and permanent fenders 46 are arranged on the outsides and on the underside of the longitudinally extending hoses. The baskets are provided with portions of a generally upright splash wall 47 which is slightly higher at the two end baskets. The splash wall 47 provides protection against splash water and advantageously does not project beyond the hoses in a horizontal direction in order to avoid engagement with the shore walls during use of the boat in wild-water channels.

Due to the fact that the air chambers 33*a* to 33*d*, which form the bend links, are blown up with only a relatively low pressure, they are very soft and easily deformable. In relationship to them, the remaining hose parts are inflated at higher pressures and act as practically rigid members, so that the units of the boat can move with respect to one another, due to the bend links, about horizontal axes which extend substantially transversely through the air chambers 33*a* to 33*d*. However, it is possible for the air chambers 33*a* to 33*d* to slightly bend so that relative movement of the units occurs about vertical axes. The units can also be moved to a certain degree parallel to one another in directions perpendicular to the longitudinal axis of the boat. The walls of the boat which define the air chambers 33*a* to 33*d* are preferably manufactured of a more flexible and more crushable material than the remaining frame parts and cross-connecting members which are also built as hose parts. By adjusting the air pressure in the air chambers 33*a* to 33*d*, it is possible to adjust to a desired degree the slackness and wobbliness and thus the softness of the connection between the units.

Figure 4:
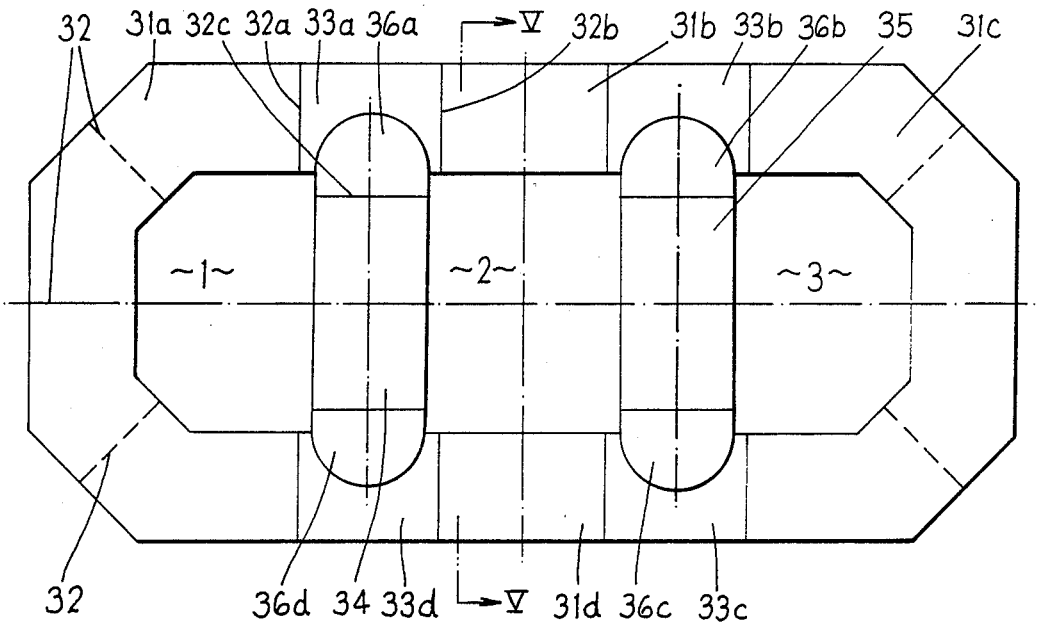
FIG. 4 is a top view of the linked boat according to FIG. 3 with baskets thereof omitted.
Figure 5:
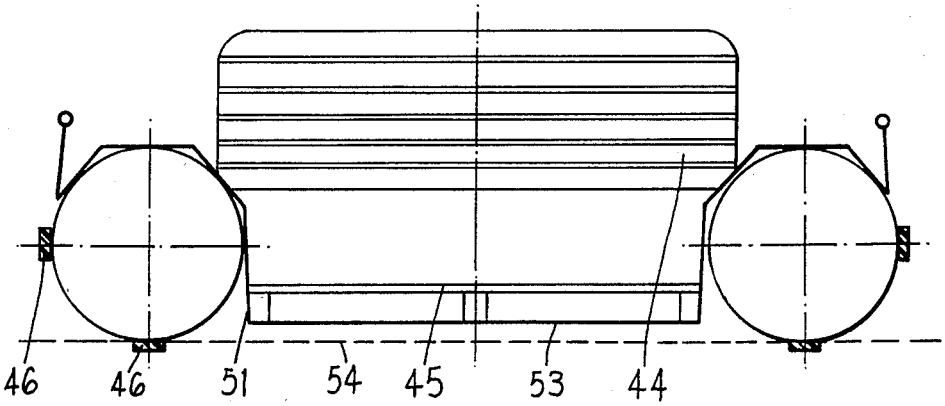
FIG. 5 is a diagrammatic sectional front view of the linked boat according to FIGS. 3 and 4 taken along the line V—V in FIG. 4.

The boat which is illustrated in FIGS. 3 and 4 has a length of approximately 5 to 6 m. and is intended to carry six persons. It is understood that the boat can be built substantially longer and so as to carry considerably more people by adding further units.

Due to the fact that the portions of the baskets which extend into the water are like substantially rectangular boxes, a structure is provided which is course-stabilizing and produces the flow resistance which is necessary to propel a boat which is driven by the flow of the water. The bottom surfaces 51 of the baskets which are immersed in the water and extend in the longitudinal direction of the boat ensure that the boat is urged to the portion of the water stream (as a rule the channel center) where the largest stream velocity exists. The surfaces 52 of the baskets which extend into the water and extend perpendicular to the longitudinal direction of the boat ensure that the longitudinal axis of the boat extends in the flow direction. In this manner, a cross-cutting of the boat in the channel is prevented. With this, a quick operating sequence on commercial wild-water paths is furthered.

Figure 6:
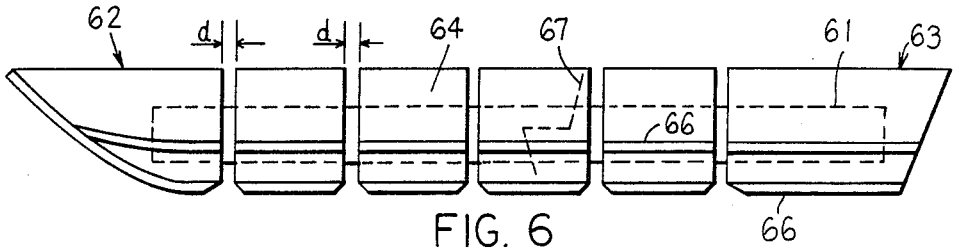
FIG. 6 is a side view of a further embodiment of a linked boat according to the invention.
Figure 7:
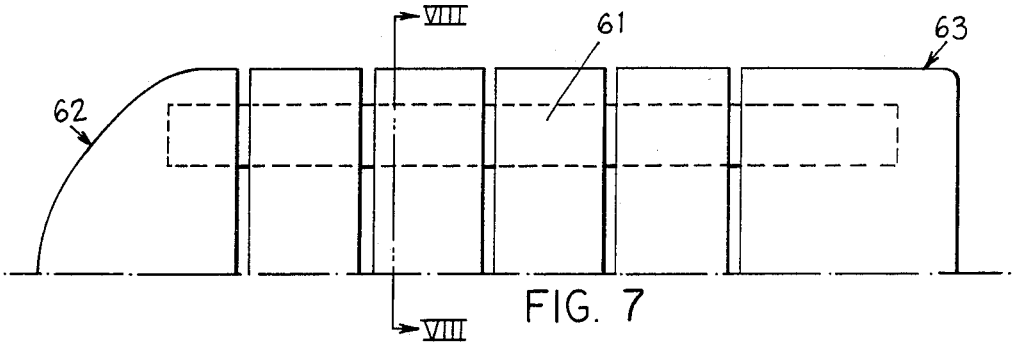
FIG. 7 is a diagrammatic partial top view of the linked boat according to FIG. 6.
Figure 8:
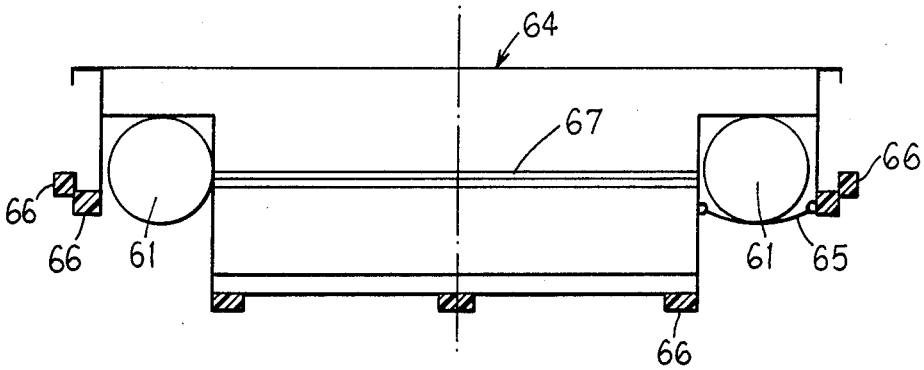
FIG. 8 is a diagrammatic sectional front view of the linked boat according to FIGS. 7 and 8 taken along the line VIII—VIII in FIG. 7.

A different exemplary embodiment is illustrated in FIGS. 6 to 8. This boat has two substantially parallel, long, flexible (elastically deformable) floating members 61, which preferably are constructed as air hoses. The ends of these hoses are inserted in corresponding receiving openings in a rigid front unit 62 and a rigid rear unit 63 and are connected fixedly to these units. Rigid baskets or central units are insertable one behind the other in the space between the front unit 62 and the rear unit 63, which baskets are placed onto the floating members 61 and are secured releasably to same. The fastening can for example be effected with elastic cords or expanders 65, which grip around the floating member 61. Due to the flexibility of the floating members 61, the links can move pivotally with respect to one another and/or can move parallel to one another. The degree of pivotal and parallel movement can be adjusted by proper selection of the degree of the flexibility of the floating members 61 and the distance d between two adjacent baskets or between a basket and a front or rear part 62, 63. Seating banks 67 are arranged in the baskets, as in one of the baskets in FIG. 6 and as can be recognized better in the enlarged cross-sectional illustration according to FIG. 8. The basket 64 which is illustrated in FIG. 8 is constructed at its sides so that it has a downwardly open recess which receives the floating members 61 from three sides with a tolerance which is appropriate for moving it over the members 61. An elastic rope 65 is then stretched across the lower end of the recess. The baskets 64 and the front unit 62 and the rear unit 63 are provided with laterally and downwardly protective permanent fenders 66. The boat according to FIGS. 6 to 8 is particularly suited for so-called rapid trips in artificially created water paths. It is thereby guided by the illustrated protective and permanent fenders in a channel in which the boat is supported.

Floatable linked boats have been described above. It often happens in artificial wild-water paths, in particular in the case of rapid paths, that the trough or channel does not always carry sufficient water in order to maintain the vehicle in a floating condition. Finally, closed path systems are also conceivable which carry no water at all or carry only a small amount of water which serves practically only for lubrication. In order to make the above-described linked vehicle suitable also for operation in such troughs, according to a further development of the invention all or a portion of the units of the vehicle are provided with sliding surfaces on their underside, with which surfaces the vehicle can be placed on a fixed base which as a rule is the bottom of the navigational channel or path which guides the vehicle. The term "underside" means the regions of the unit on which the unit is supported when it is set down on the path. In the case of a path which is arcuate in a direction transverse to the longitudinal direction, namely where the path has upwardly curved side walls, inclined regions of the units engageable therewith also are to be considered part of the "underside". Since the rigid sliding surfaces are provided individually for each unit, the bendability and movability of the links with respect to one another is not changed.

The construction of such a sliding vehicle with individual links which can be pivoted with respect to one another and which are connected movably permits a cork-screw motion, which is important during the use of the vehicle in recreational and amusement travelling systems for increasing the feeling of travel.

The sliding surfaces can be constructed in such a manner that the undersurfaces of the downwardly projecting baskets are covered over the whole surface with material capable of sliding. Another possibility consists in providing runners on these baskets or on the frame parts, which runners in turn are made of or are covered with a material capable of sliding.

Furthermore, it is also possible to provide sliding surfaces on the sides of the units, which surfaces are effective when the vehicle engages a side wall of the guiding trough.

The frame parts and/or the cross-connecting members can in this vehicle, according to the invention, be constructed as floating members, so that the vehicle is at the same time floatable. This amphibian design has the advantage that the vehicle can be caught at the lower end of the path in a water basin. However, it is also possible to construct the frame parts and/or cross-connecting members of a nonfloating material, for example of simple beams or profile carriers. Also, it is not necessary to construct the baskets so that they are closed downwardly if an immersion into water is not intended.

The material of the sliding surfaces must be created such that it has a friction coefficient which is as small as possible on the material of the guiding path. For this, special plastics are preferable, for example Hostalen which is sold commercially under the name "GUR". The path which forms the base on which the vehicle slides may for example be made of steel or plastic.

The use of a vehicle with sliding surfaces has, compared with a vehicle with wheels, the advantage of considerably greater contact surfaces. By using wheels, the carrying path is very quickly damaged and becomes unusable because of the high support pressure.

As a rule, all units of a vehicle according to the invention are provided with sliding surfaces. However, it is conceivable that some units could have no sliding surfaces and be carried along without bottom or side contact with the guiding channel by the adjacent units.

Figure 9:
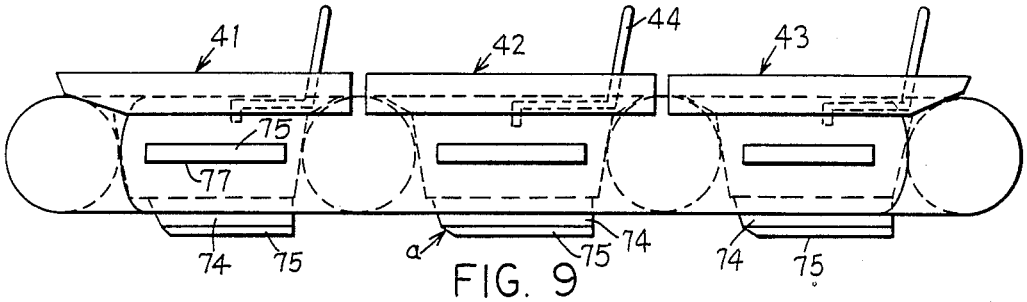
FIGS. 9 to 11 are views similar to FIGS. 3 to 5 and illustrate a floatable linked vehicle which embodies the present invention and is capable of sliding on a fixed base.
Figure 10:
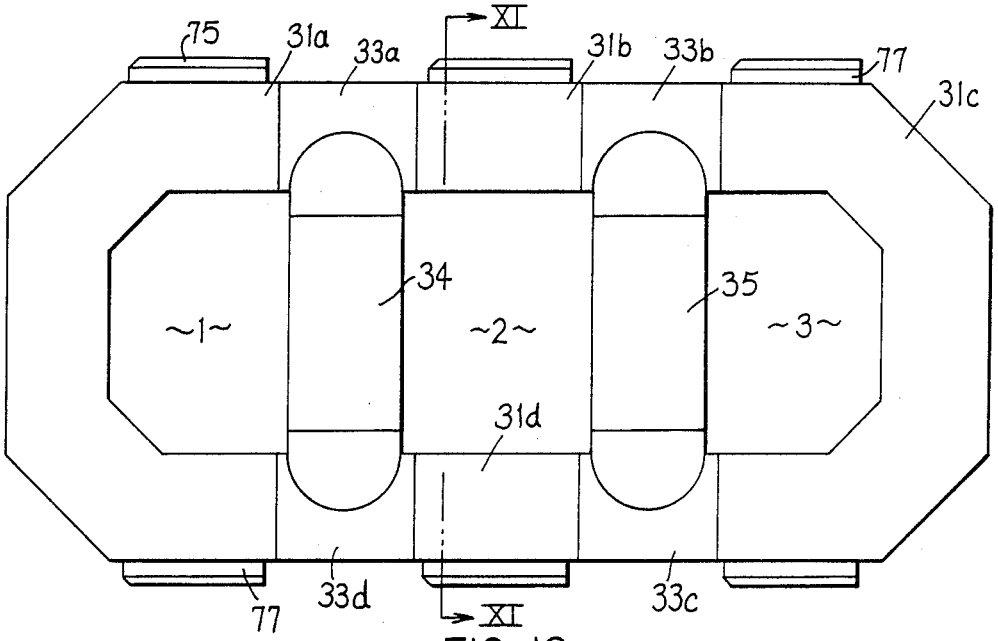
Figure 11:
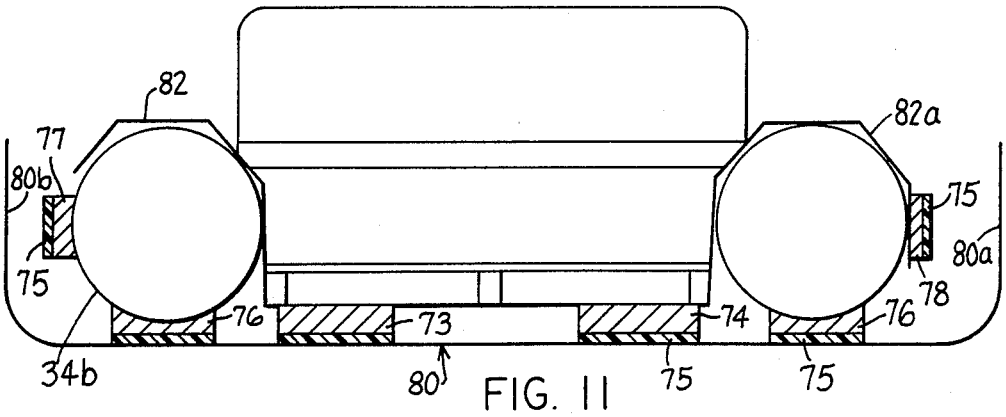

A first exemplary embodiment of this further development according to the invention is illustrated in FIGS. 9 to 11. These figures are respectively similar to FIGS. 3 to 5 and illustrate a floatable linked vehicle which differs from the vehicle of FIGS. 3 to 5 in that it can be placed on a fixed base and is capable of sliding well thereon. According to this further development of the invention, the individual units 1 to 3 of the vehicle are provided with sliding surfaces, namely runners 73 and 74, which extend longitudinally of the units and are provided on the flat underside of the baskets 41 to 43. The bottom surfaces of the runners, which contact the bottom of the channel 80, are covered with a layer of a highly slidable material 75, which is chosen such that the friction coefficient with the material of the channel 80 is very small. It is furthermore possible that runners 76 with a cover of the material 75 are provided on the frame parts, as is indicated for example in FIG. 11 for the frame part 31*b*. Since the linked vehicle, during its travel through the channel and in particular around curves, can also hit the side walls 80*a* and 80*b* of the channel, it is possible to provide sliding surfaces on the sides of the units. These sliding surfaces can be secured directly on the frame, as is shown for the frame part 31*b* in FIG. 11, where a runner 77 with a slidable material 75 is arranged on the outer side of the frame part. The runners 77 with sliding surfaces are illustrated for all six frame parts in FIG. 10. A different possibility is that the supports or carriers 82 with which the basket rests on the frame extend further around the frame part, as is shown for the support 82*a* in FIG. 11. A runner 78 with a layer of the slidable material is then secured directly on the support 82*a*.

Figure 12:
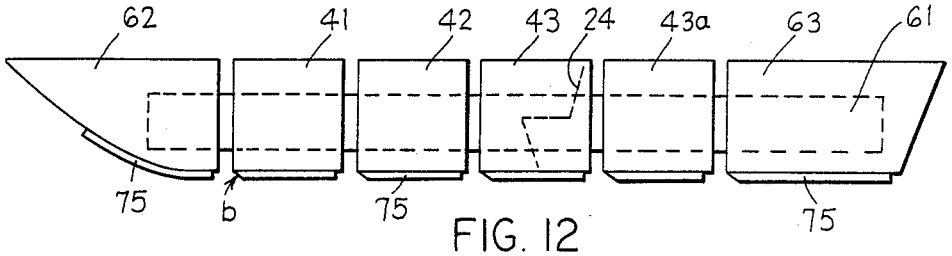
FIGS. 12 to 14 are views similar to FIGS. 6 to 8 and illustrate a floatable or nonfloatable linked vehicle which embodies the present invention and is capable of sliding on a fixed base.
Figure 13:
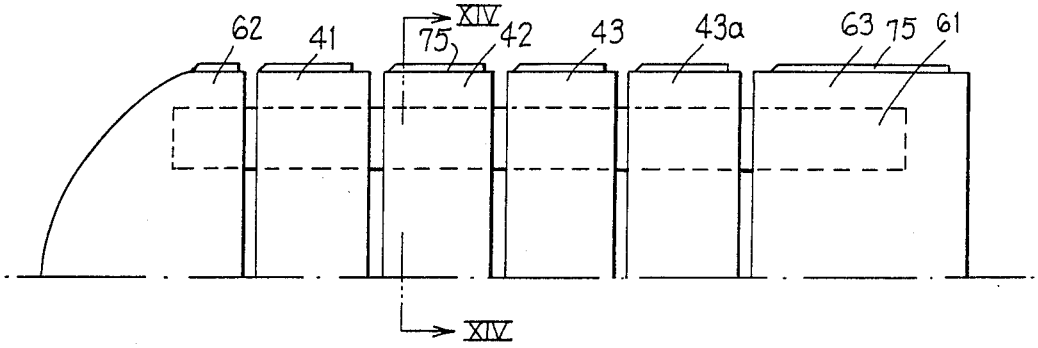
Figure 14:
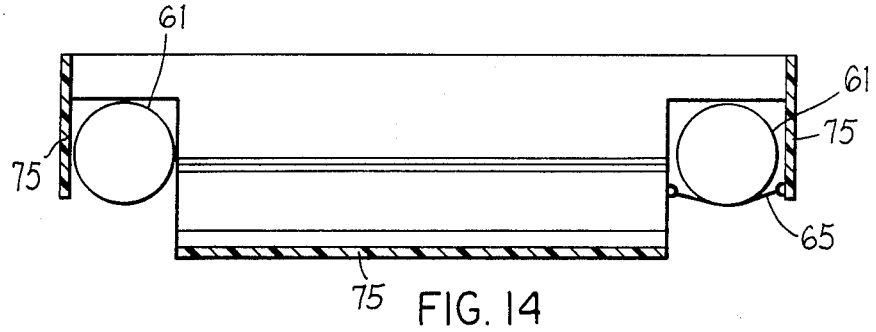

FIGS. 12 to 14 illustrate a further linked vehicle somewhat similar to that in FIGS. 6 to 8, wherein for corresponding parts the same reference numerals are again used. Also, FIGS. 12 to 14 are views which respectively correspond to FIGS. 6 to 8. According to the further development of the invention, the bottom surfaces of the baskets 41 to 43*a* are covered with a highly slidable material 75. The same is also true for the front and rear frame parts 62, 61. Also in this embodiment, it is possible to cover the parts of the baskets or the individual units which project the farthest laterally with a highly slidable material 75, as can be recognized in FIGS. 13 and 14. The two nonrigid frame parts 61 can, instead of floating members, be nonfloatable rubber rods.

Naturally, it is also possible in the embodiment according to FIGS. 12 to 14 to provide, instead of the highly slidable material which is applied to the surfaces of the baskets, runners which are covered with a layer of the slidable material, in a manner similar to that illustrated in FIGS. 9 to 11. On the other hand, it is also possible in the embodiment according to FIGS. 9 to 11 to, in place of the runners, apply slidable material directly on the surfaces of the baskets. However, the baskets must extend sufficiently far downwardly so that their lowest surfaces lie below the lowest surfaces on the frame.

In the two exemplary embodiments according to FIGS. 9–14, the runners, or the slidable material which is applied directly on the units, can extend the full length of the units or over only a portion of this length. Attention should always be focused on achieving optimum relationships between the entire friction on the one hand and the support pressure on the guiding channel on the other hand. The slidable surfaces which touch the bottom or the side walls of the channel are preferably inclined upwardly at the front edge thereof, as is for example indicated at a in FIG. 9 or at b in FIG. 12.

Figure 15:
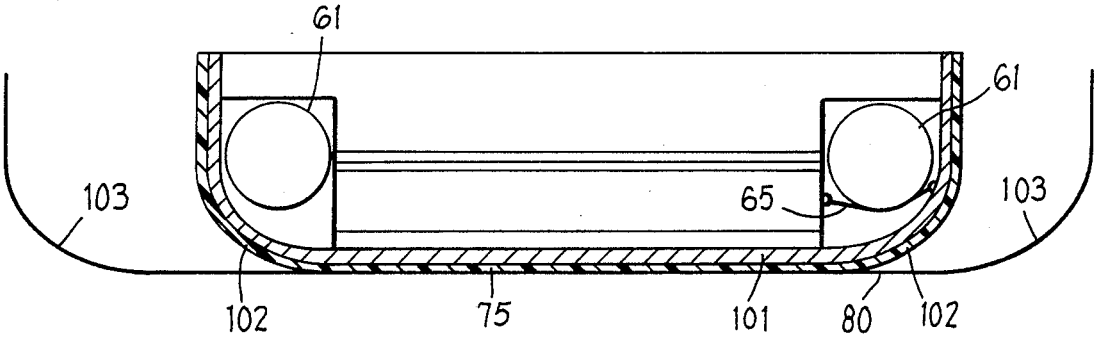
FIG. 15 is a sectional view similar to FIG. 14 but showing a different arrangement for mounting the sliding surfaces and showing the fixed base.

FIG. 15 illustrates a further exemplary embodiment according to the invention with a different construction of the sliding surfaces. The sliding surface 101 consists hereby of a band which extends transversely with respect to the longitudinal direction of the vehicle and extends transversely over the bottom and side surfaces of the unit. At the transition zones 102 between the bottom and side surfaces of the basket or unit, the band 101 follows a curve which conforms to the curve 103 of the guiding channel. The band can be constructed as a self-carrying member, or it can be provided with a support construction in the region of the transition zone 102. The band can be made of a highly slidable material, or can be covered with such a material, 75 on its outside. The band can also be designed so that it extends only over the transition zone 102. In the longitudinal direction of the unit, the band 101 can extend the entire length of the unit or there can be several bands which are longitudinally spaced from one another.

The slidable material can be supported in any desired manner on the surfaces of the unit. For example screws, gluing or welding can be considered. The slidable surfaces can be provided with scales or grooves which resist a backward sliding of the vehicle and/or can be designed so that, when water exists in the channel, water can more easily form a sliding film between the sliding surface and the channel bottom.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A linked vehicle, comprising a plurality of longitudinally spaced units which are substantially rigid and are connected by bend links which permit limited movement of the units relative to one another, each said unit including a substantially rigid frame part which has an upwardly open region, said frame parts of adjacent said untis being connected at their longitudinally adjacent ends by said bend links and said bend links being elastically deformable intermediate members, and each said unit further including a rigid basket which is removably disposed in said upwardly open region of and is supported by the associated frame part, wherein said intermediate members each include an inflatable chamber, and wherein the gas pressure in each said chamber is selected so that said intermediate members are softer than and can be deformed substantially easier than said substantially rigid frame parts.

2. A linked vehicle, comprising a plurality of longitudinally spaced units which are substantially rigid and are connected by bend links which permit limited movement of the units relative to one another, each said unit including a substantially rigid frame part which has an upwardly open region, said frame parts of adjacent said units being connected at their longitudinally adjacent ends by said bend links and said bend link being elastically deformable intermediate members, and each said unit further including a rigid basket which is removably disposed in said upwardly open region of and is supported by the associated frame part, wherein each said frame part has two portions which are spaced in a transverse direction and are connected with one another by cross-connecting members which are eahc positioned as close as possible to the intermediate members between adjacent said units so that the width of said vehicle is exactly determined, wherein said frame parts, said cross-connecting members and said intermediate members each include an inflatable hose piece, said hose pieces having cross sections which are substantially the same size, and wherein connections between said frame parts, cross-connecting members and intermediate members are effected by one of vulcanizing and welding.

* * * * *